US008739535B2

(12) United States Patent
Kopecek et al.

(10) Patent No.: US 8,739,535 B2
(45) Date of Patent: Jun. 3, 2014

(54) FLUID FEEDBACK PUMP TO IMPROVE COLD START PERFORMANCE OF ORGANIC RANKINE CYCLE PLANTS

(75) Inventors: Herbert Kopecek, Hallbergmoos (DE); Gabor Ast, Garching (DE); Sebastian Freund, Unterfoehring (DE); Thomas Johannes Frey, Regensburg (DE); Pierre Sebastien Huck, Munich (DE); Simon Schoewel, Moosthenning (DE)

(73) Assignee: General Electric Company, Niskayuna, NY (US)

( * ) Notice: Subject to any disclaimer, the term of this patent is extended or adjusted under 35 U.S.C. 154(b) by 1033 days.

(21) Appl. No.: 12/642,510

(22) Filed: Dec. 18, 2009

(65) Prior Publication Data

US 2011/0146277 A1 Jun. 23, 2011

(51) Int. Cl.

| | |
|---|---|
| ***F01K 13/02*** | (2006.01) |
| ***F01K 25/08*** | (2006.01) |
| ***F01K 25/00*** | (2006.01) |

(52) U.S. Cl.

USPC ..... 60/646; 60/651; 60/671

(58) Field of Classification Search

USPC ..... 60/651, 661, 670, 671

See application file for complete search history.

(56) References Cited

U.S. PATENT DOCUMENTS

| | | | | |
|---|---|---|---|---|
| 2002/0066270 | A1* | 6/2002 | Rouse et al. | 60/670 |
| 2005/0160750 | A1* | 7/2005 | Shaffer et al. | 62/228.1 |
| 2005/0247056 | A1 | 11/2005 | Cogswell et al. | |
| 2008/0141673 | A1* | 6/2008 | Lehar et al. | 60/651 |
| 2009/0211253 | A1* | 8/2009 | Radcliff et al. | 60/670 |

FOREIGN PATENT DOCUMENTS

| | | | |
|---|---|---|---|
| DE | 10052414 | A1 | 5/2002 |
| WO | WO2009134271 | A1 | 11/2009 |

OTHER PUBLICATIONS

DE10052414 English Abstract.
WO2009134271 English Abstract.

* cited by examiner

*Primary Examiner* — Kenneth Bomberg
*Assistant Examiner* — Paul Thiede
(74) *Attorney, Agent, or Firm* — Ann M. Agosti

(57) ABSTRACT

A system and method improves cold start performance of an organic Rankine cycle (ORC) plant. The system includes one or more pumps configured to pump condensed fluid from points of natural accumulation of the condensed fluid within an ORC loop back into a corresponding low pressure liquid storage vessel shortly after shutting down the ORC plant to ensure the start-up routine works properly for the next ORC plant start event. One or more of the pumps can also be configured to pump fluid away from the ORC expansion machine(s) at any time prior to starting the ORC if the fluid is in a liquid phase.

8 Claims, 1 Drawing Sheet

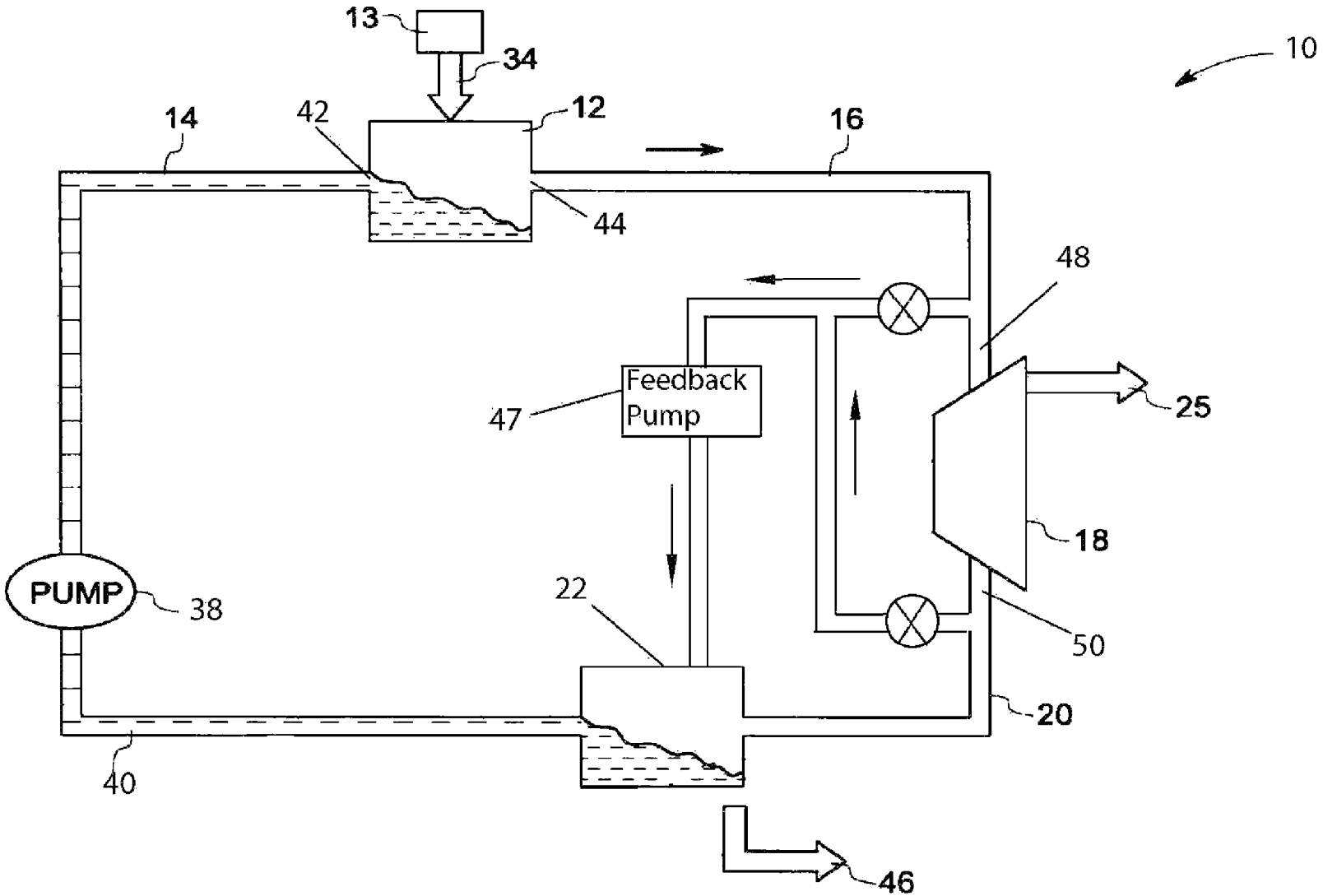
10
25
48
18
50
20
16
46
Feedback Pump
12
44
34
22
47
13
42
14
38
PUMP
40

FLUID FEEDBACK PUMP TO IMPROVE COLD START PERFORMANCE OF ORGANIC RANKINE CYCLE PLANTS

BACKGROUND

This invention relates generally to organic Rankine cycle plants, and more particularly to methods and apparatus for improving cold start performance of organic Rankine cycle plants.

Rankine cycles use a working fluid in a closed cycle to gather heat from a heating source or a hot reservoir by generating a hot gaseous stream that expands through a turbine to generate power. The expanded stream is condensed in a condenser by rejecting the heat to a cold reservoir. The working fluid in a Rankine cycle follows a closed loop and is re-used constantly. The efficiency of Rankine cycles such as Organic Rankine Cycles (ORC)s in a low-temperature heat recovery application is very sensitive to the temperatures of the hot and cold reservoirs between which they operate. In many cases, these temperatures change significantly during the lifetime of the plant. Geothermal plants, for example, may be designed for a particular temperature of geothermal heating fluid from the earth, but lose efficiency as the ground fluid cools over time. Air-cooled ORC plants that use an exhaust at a constant temperature from a larger plant as their heating fluid will still deviate from their design operating condition as the outside air temperature changes with the seasons or even between morning and evening.

Current ORC plant designs are problematic in that the working fluid(s) condense and settle down inside the loop after the plant shuts down and/or in front or after the expanders. Plant start-up is particularly difficult and may fail with the highly viscous fluid blocking the expansion machines during cold ambient temperatures.

In view of the foregoing, it would be advantageous to provide methods and apparatus for ensuring the start-up routine associated with Organic Rankine Cycle plants works properly for each start event.

BRIEF DESCRIPTION

According to one embodiment, an Organic Rankine Cycle (ORC) plant comprises:

a boiler configured to receive heat from an external source and a liquid stream and to generate a vapor stream there from;

an expander configured to receive the vapor stream and to generate power and an expanded stream there from;

a condenser configured to receive the expanded stream and to generate the liquid stream there from, wherein the liquid stream and the vapor stream together form a closed ORC loop; and one or more pumps configured to pump condensed fluid from points of natural accumulation of the condensed fluid in the ORC loop back into the condenser shortly after shutting down the ORC plant.

According to another embodiment, an Organic Rankine Cycle (ORC) condensation pump system for improving cold start performance of an ORC plant comprises one or more pumps configured to pump condensed fluid from points of natural accumulation of the condensed fluid within an ORC loop back into a corresponding low pressure liquid storage vessel shortly after shutting down the ORC plant such that a corresponding liquid feed pump can convert the stored low pressure liquid to a high pressure liquid within the ORC loop.

According to yet another embodiment, a method of improving cold start performance of an Organic Rankine Cycle (ORC) plant comprises:

providing one or more liquid pumps configured to pump fluid from a place of natural accumulation in close proximity to one or more expanders within an ORC operating loop; and pumping condensed fluid from points of natural accumulation of the condensed fluid within the ORC loop back into a corresponding low pressure liquid storage vessel shortly after shutting down the ORC plant.

DRAWINGS

These and other features, aspects, and advantages of the present invention will become better understood when the following detailed description is read with reference to the accompanying drawing, wherein:

The FIGURE illustrates an Organic Rankine Cycle (ORC) plant in which embodiments of the invention are integrated therein.

While the above-identified drawing figure sets forth one embodiment, other embodiments of the present invention are also contemplated, as noted in the discussion. In all cases, this disclosure presents illustrated embodiments of the present invention by way of representation and not limitation. Numerous other modifications and embodiments can be devised by those skilled in the art which fall within the scope and spirit of the principles of this invention.

DETAILED DESCRIPTION

The FIGURE represents an exemplary organic Rankine cycle (ORC) plant 10 for power generation according to one embodiment of the invention. The ORC plant 10 includes a boiler 12 configured to receive heat from an external source 13 and a liquid stream 14 and to generate a vapor stream 16. The ORC plant 10 also includes an expander 18 configured to receive the vapor stream 16 and to generate power 25 by rotating the mechanical shaft (not shown) of the expander 18 and an expanded stream 20. A condenser 22 is configured to receive the expanded stream 20 and to regenerate the liquid stream 14. The liquid stream 14 and the vapor stream 16 along with the vapor and liquid phase within the boiler 12 and condenser 22 form the working fluid of the Rankine cycle shown in the Figure.

In a Rankine cycle, the working fluid is pumped (ideally isentropically) from a low pressure to a high pressure by a pump 38. Pumping the working fluid from a low pressure to a high pressure requires a power input (for example mechanical or electrical). The high-pressure liquid stream 14 enters the boiler 12 where it is heated at constant pressure by an external heat source 13 to become a saturated vapor stream 16. Common heat sources for organic Rankine cycles are exhaust gases from combustion systems (power plants or industrial processes), hot liquid or gaseous streams from industrial processes or renewable thermal sources such as geothermal or solar thermal. The superheated or saturated vapor stream 16 expands through the expander 18 to generate power output (as shown by the arrow 25). In one embodiment, this expansion is isentropic. The expansion decreases the temperature and pressure of the vapor stream 16. The vapor stream 16 then enters the condenser 22 where it is cooled to generate a saturated liquid stream 40. This saturated liquid stream 40 re-enters the pump 38 to generate the liquid stream 14 and the cycle repeats.

As described above, the power generation system 10 represents a Rankine cycle where the heat input is obtained through the boiler 12 and the heat output is taken from the condenser 22. In operation, the boiler 12 is connected to an inlet 42 and outlet 44. The arrow 34 indicates the heat input into the boiler 12 from the external heat source 13 and the arrow 46 indicates the heat output from the condenser 22 to a cold reservoir. In some embodiments, the cold reservoir is the ambient air and the condenser 22 is an air-cooled or water-cooled condenser. In some embodiments, the liquid stream 14 comprises two liquids namely a higher boiling point liquid and a lower boiling point liquid. Embodiments of the boiler 12 and the condenser 22 can include an array of tubular, plate or spiral heat exchangers with the hot and cold fluid separated by metal walls.

Current ORC plant designs are problematic in that the working fluid(s) condense and settle down inside the loop after the plant shuts down and/or in front or after the expanders such as stated above. Plant start-up is particularly difficult and may fail with the highly viscous fluid blocking the expansion machines 18 during cold ambient temperatures. ORC plant 10 remedies the foregoing start-up difficulties by including one or more feedback pumps 47 configured to pump condensed fluid from points of natural accumulation 48, 50 of the condensed fluid within the ORC loop back into a corresponding low pressure liquid storage vessel, e.g. condenser 22 shortly after shutting down the ORC plant 10. One or more of the pumps can also be configured to pump fluid away from the ORC expansion machine(s) immediately to or at any time prior to starting the ORC if the fluid is in a liquid phase. This ensures the ORC plant 10 start-up routine works properly for the next ORC plant start event. Feedback pump (s) 47 can be one or more additional pumps or can also be one or several of any lubrication pumps already used to lubricate the expansion machine(s) 18, if they are able to operate in both flow directions and if they use the working fluid as the lubricant. The feedback pump(s) 47 will operate also to pump any fluid remaining in the expander(s) 18 shortly after shutdown. ORC plant 10 advantageously can operate effectively in cold regions such as, without limitation, pipe line stations in northern regions of North America, a feature that is difficult or not feasible to achieve using known ORC plant architectures.

While the invention has been described in terms of various specific embodiments, those skilled in the art will recognize that the invention can be practiced with modification within the spirit and scope of the claims.

What is claimed is:

1. An organic Rankine cycle (ORC) plant comprising:

a boiler configured to receive heat from an external source and to further receive a liquid stream and to generate a vapor stream there from;

an expander configured to receive the vapor stream and to generate power and an expanded stream there from, wherein the expander comprises an input fluidically coupled directly to a first valve, and further comprises an output fluidically coupled directly to a second valve;

a condenser comprising a first input configured to receive the expanded stream and to generate the liquid stream there from, the condenser further comprising a second input; and at least one condensation fluid feedback pump, the at least one condensation fluid feedback pump comprising an input fluidically coupled directly to both the first valve and the second valve, and further comprising an output fluidically coupled directly to the condenser second input, wherein the liquid stream and the vapor stream together form a closed ORC loop, and further wherein the at least one condensation fluid feedback pump is configured to pump condensed fluid from a plurality of points of natural accumulation of the condensed fluid in the ORC loop directly into the condenser via the condenser second input.

2. The ORC plant according to claim 1, wherein the plurality of points of natural accumulation are associated with the expander.

3. An organic Rankine cycle (ORC) plant condensation pump system for improving cold start performance of an ORC plant comprising at least one condensation fluid pump, wherein the at least one condensation fluid pump comprises an output fluidically coupled directly to a fluid input to a low pressure liquid storage vessel, and further wherein the at least one condensation fluid pump comprises an input fluidically coupled directly via a first valve to an input of an expander and further fluidically coupled directly via a second valve to an output of the expander, wherein the at least one condensation fluid pump is configured to pump condensed fluid from a plurality of points of natural accumulation of the condensed fluid within an ORC loop directly into the low pressure liquid storage vessel.

4. The ORC plant condensation pump system according to claim 3, wherein the plurality of points of natural accumulation are associated with the expander.

5. The ORC plant condensation pump system according to claim 3, wherein the low pressure liquid storage vessel comprises a condenser.

6. A method of improving cold start performance of an organic Rankine cycle (ORC) plant, the method comprising:

fluidically coupling an output of at least one condensation fluid pumps directly to at least one input of a low pressure liquid storage vessel within an ORC operating loop;

fluidically coupling an input of the at least one condensation fluid pump directly to both a first valve and a second valve;

fluidically coupling the first valve directly to an input of at least one expander within the ORC operating loop;

fluidically coupling the second valve directly to an output of the at least one expander within the ORC operating loop; and pumping via the at least one condensation fluid pump, condensed fluid away from a plurality of places of natural fluid accumulation associated with the ORC operating loop directly into the low pressure liquid storage vessel.

7. The method of improving cold start performance of an ORC plant according to claim 6, wherein pumping condensed fluid from the plurality of places of natural accumulation comprises pumping condensed fluid accumulated within the expander.

8. The method of improving cold start performance of an ORC plant according to claim 6, wherein pumping condensed fluid from the plurality of places of natural accumulation of the condensed fluid within the ORC loop directly into a low pressure liquid storage vessel comprises pumping condensed fluid directly into a condenser.

* * * * *